US007891530B2

(12) United States Patent
Schultze et al.

(10) Patent No.: US 7,891,530 B2
(45) Date of Patent: Feb. 22, 2011

(54) METHOD FOR AXIAL CORRECTION IN A PROCESSING MACHINE, AS WELL AS A PROCESSING MACHINE

(75) Inventors: Stephan Schultze, Lohr am Main (DE); Holger Schnabel, Rottendorf (DE)

(73) Assignee: Robert Bosch GmbH, Stuttgart (DE)

( * ) Notice: Subject to any disclaimer, the term of this patent is extended or adjusted under 35 U.S.C. 154(b) by 275 days.

(21) Appl. No.: 12/182,427

(22) Filed: Jul. 30, 2008

(65) Prior Publication Data

US 2009/0039130 A1 Feb. 12, 2009

(30) Foreign Application Priority Data

Aug. 9, 2007 (DE) ..... 10 2007 037 564

(51) Int. Cl.
*B65H 43/08* (2006.01)
*B65H 23/04* (2006.01)

(52) U.S. Cl. ..... 226/24; 226/29; 226/2

(58) Field of Classification Search ..... 226/24, 226/25, 29, 30, 2
See application file for complete search history.

(56) References Cited

U.S. PATENT DOCUMENTS 3,669,328 A * 6/1972 Castelli ..... 226/97.4
4,805,501 A * 2/1989 Nuttin ..... 83/300
4,966,352 A * 10/1990 Nuttin ..... 270/1.01
5,285,554 A * 2/1994 Jean et al. ..... 19/163
5,289,617 A * 3/1994 Jean et al. ..... 19/163
5,320,039 A * 6/1994 Reponty et al. ..... 101/228
5,341,543 A * 8/1994 Jean et al. ..... 19/163
7,156,339 B2 * 1/2007 Nicolai ..... 242/547
2004/0129822 A1 * 7/2004 Nicolai et al. ..... 242/541.6
2006/0076451 A1 * 4/2006 Biagiotti et al. ..... 242/532.3
2007/0079712 A1 * 4/2007 Costrop et al. ..... 101/228

* cited by examiner

*Primary Examiner*—Evan H Langdon
(74) *Attorney, Agent, or Firm*—Michael J. Striker

(57) ABSTRACT

In a method for axial correction in a processing machine (100), which has at least two driven transport axles (110, 115) for transporting and processing a product web (101), at least one non-driven or driven processing axle (111, 112, 113, 114), and at least one additional non-driven axle (102, 121, 122, 123, 124), wherein the product web (101) is divisible into at least one web-tensioning segment, a web-tensioning segment is delimited by two clamping points (110-115). The clamping points are embodied in the form of driven transport or processing axles. During a rotation speed change of a clamping point (110-115) a web-tensioning segment is delimited, a pilot control of this clamping point (110-115) delimiting the web-tensioning segment and/or of a processing axle (111-114) situated in this web-tensioning segment is carried out, taking into account a moment of inertia of a non-driven axle (102, 121-124) situated in this web-tensioning section, and a corresponding processing machine (100).

9 Claims, 3 Drawing Sheets

METHOD FOR AXIAL CORRECTION IN A PROCESSING MACHINE, AS WELL AS A PROCESSING MACHINE

BACKGROUND OF THE INVENTION

The invention relates to a method for axial correction in a processing machine and a corresponding processing machine, a corresponding computer program, and a corresponding computer program product.

Although the discussion below will concentrate chiefly on printing machines, the invention is not limited to them, but is instead intended for all types of processing machines with driven and non-driven axles and rolls. In particular, the invention can be used in printing machines such as newspaper printing machines, commercial printing machines, rotogravure printing machines, packaging printing machines, or security paper printing machines as well as in processing machines such as bag machines, envelope machines, or packaging machines.

In processing machines, in particular printing machines, a product web is conveyed along by driven axles (web transport axles) such as draw rolls or advancing rolls and non-driven axles such as deflecting rolls, guide rolls, or cooling rolls. The product web, which can be composed of paper, fabric, cardboard, plastic, metal, or rubber and can be embodied in sheet form, etc., is simultaneously processed, e.g. printed, stamped, cut, folded, etc., usually by means of likewise driven processing axles. The driven axles influence the web tension and the stretching of the product web, which is usually controllable, and provide for the transport of the product web via the non-driven axles.

The driven axles include the infeed unit and outfeed unit as well as driven processing axles, for example printing cylinders. These rolls influence the adjustment of the web tension and the register, e.g. color register. The non-driven axles perform the function of web guidance and are driven indirectly by means of the product web. The moment of friction of these non-driven rolls influences the web tension and results in a stationary register error between the individual processing axles.

In conventional processing machines, it is usual to work with external register controls.

In an acceleration or deceleration phase (rotation speed change), a dynamic force must be used in order to accelerate or decelerate the non-driven axles. This requires application of the friction and moment of inertia of the non-driven rolls. During the acceleration phase, the web tension decreases in the web transport direction before the non-driven axle and after it, increases again until reaching the next driven axle. These occurrences influence the web tension and stretching, and thus the baseline alignment of the product web processing.

In the prior art, occurrences of acceleration and deceleration are only taken into account to a small degree in the regulation of web tension and register, e.g. by taking into account a permanently stored run-up curve of the processing axles or by taking into account permanently stored constant changes in web tension set point values.

These measures have the disadvantage that with the occurrence of accelerations, errors in the register and in the web tension are taken into account based not on the current acceleration value, but on a permanently stored one, thus requiring correction of all errors that occur as a regulating difference of a web tension regulator or a register regulator.

SUMMARY OF THE INVENTION

The object of the present invention, therefore, is to reduce the negative influence of the non-driven axles on the web tension and/or the web register during the acceleration phase and the deceleration phase.

This object is attained by means of a method for axial correction, a processing machine, a computer program, and a computer program product.

A processing machine according to the invention, in particular a printing machine, has at least two driven transport axles for transporting and processing a product web, at least one non-driven or driven processing axle, and at least one additional non-driven axle. As has already been explained above, a non-driven axle is not equipped with its own drive unit, but is instead driven by means of the product web that acts on it in a frictionally engaging or form-locked fashion. The product web can be divided into at least one web-tensioning segment; a web-tensioning segment is delimited by two clamping points embodied in the form of driven transport axles or processing axles. Additional driven and/or non-driven axles can be situated within the web-tensioning segment. The clamping points delimiting a web-tensioning segment are used to adjust or regulate the web tension in this segment. Often, the entire product web can be divided into a number of web-tensioning segments, sometimes even with different web tension set point values.

A processing machine according to the invention also has a computing unit that is equipped, during a rotation speed change of a clamping point delimiting a web-tensioning segment, to carry out a pilot control of this clamping point delimiting the web-tensioning segment and/or of a processing axle situated in this web-tensioning segment by means of pilot control values, taking into account a moment of inertia of a non-driven axle situated in this web-tensioning segment. The moment of inertia to be taken into account is an effective moment that can be composed of individual physical moments. In addition to the physical moment of inertia, it is therefore possible in particular for a moment of friction to become a part of the consideration.

In a method for axial correction according to the invention, which in particular involves a regulation and adjustment of web tension and/or register, during a rotation speed change of a clamping point delimiting a web-tensioning segment, a pilot control of this clamping point delimiting the web tensioning segment and/or of a processing axle situated in this web-tensioning segment takes place, taking into account a moment of inertia of a non-driven axle situated in this web-tensioning segment.

The pilot control is advantageously applied to all of the involved axles of the web-tensioning segment. In particular, in order to regulate and adjust the web tension in a web-tensioning segment, a pilot control of the clamping points that delimit the web-tensioning segment is carried out and, in order to regulate and adjust the register of a processing axle situated in the web-tensioning segment, a pilot control of the processing axle and/or the clamping points delimiting the web-tensioning segment is carried out.

If there are a number of non-driven axles and processing axles situated within a web-tensioning segment, then this web-tensioning segment can be divided into web-tensioning subsegments, with each non-driven axle constituting an endpoint of a web-tensioning subsegment and with the processing axles being situated within the web-tensioning subsegments. Consequently, an axial correction can be carried out by means of pilot control of all of the processing axles situated within a web-tensioning subsegment, taking into account the web tension change to be expected due to the moments of inertia of the non-driven axles.

In web transport axles or processing axles, it is typical for additive speeds, multiplicative speed factors (so-called fine adjustment, transmission factors), and/or additive angular offsets to be pilot controlled.

The effective moments of inertia to be taken into account advantageously also include the friction moments of the axles. The effective moments of inertia of the non-driven axles can be determined in particular by means of a test run. Based on an evaluation of the register error of the products, it is possible to calculate back to the effective moments of inertia of the non-driven axles. It is likewise possible to carry out an online evaluation of the measured register errors. In addition to the determination by means of a test run, it is also possible to carry out a determination by means of an online observation of the register errors that occur and based on them, an estimation of the moments of inertia, for example by means of model sequence regulation, monitoring sensors, Kalman filtration, etc. Finally, it is also possible to calculate the moment of inertia through knowledge of mechanical parameters such as the diameter, material, material distribution, etc. of the non-driven axles.

The pilot control according to the invention represents a significant improvement over the prior art since it is now possible to provide a predictive pilot control of the errors to be expected instead of having to react to an error that has already occurred. The axial correction in the context of an adjustment or regulation of web tension reduces web tension changes during an acceleration or deceleration phase, which results in an immediate reduction in the number of rejects generated. The smaller changes in web tension likewise reduce register deviations, which are further reduced by means of the axial correction also described above in the context of a register regulation or control. Because of the additional pilot control, it is possible to develop more effective regulating strategies since it is possible to exercise greater influence on the product web. For example, if the printing machine has reached the steady state, it is possible to more quickly compensate for longitudinal register deviations by means of stationery regulating strategies into which the pilot control is integrated. If the machine is in a dynamic transition phase, for example due to changes in the set point value of the web tension or web speed in the machine, the pilot control permits a more rapid dynamic register regulation.

A pilot control taking into account the moments of inertia of the non-driven axles has not been previously used in the known prior art. For this reason, it is only possible to execute slow acceleration and deceleration procedures. Moreover, it is necessary to put up with a certain amount of waste generated during these phases. The present invention overcomes these disadvantages.

The measure according to the invention achieves a more significant decoupling of the product web during register and/or web tension regulating procedures and also reduces the influence of the moments of inertia and friction of the non-driven axles. There is a decrease in the stationery and dynamic error between the individual processing or printing units. Furthermore, it is possible to carry out a more rapid correction of register errors. The repercussions of an acceleration or deceleration phase on the web tension are reduced, thus in particular enabling quicker, more dynamic acceleration or deceleration procedures. On the whole, the number of rejects and the amount of waste paper are significantly reduced, which among other things, yields a decrease in production costs.

The pilot control is advantageously carried out taking into account the respective (effective) moment of inertia of all of the non-driven axles contained within this web-tensioning segment. It is thus possible to further increase the quality of the pilot control.

Preferably, the respective moments of inertia of all of the non-driven axles contained within this web-tensioning segment are concentrated into an overall moment of inertia to be taken into account for this web-tensioning segment. This is an easy-to-execute step that nevertheless delivers good results. Through a virtual "center of gravity calculation," it is now only necessary to take into account an overall moment of inertia. This overall moment of inertia can, for example, be determined in one of the above-mentioned ways (test run, etc.).

It is particularly useful if pilot control values for the pilot control of the clamping point and/or of the processing axle are cascaded in order to achieve a decoupling at clamping points and/or processing axles of adjacent web-tensioning segments. It is particularly advantageous to cascade pilot control procedures that are carried out in one web-tensioning segment and the associated pilot control values in adjacent web-tensioning segments, particularly at their web transport axles, in order to decouple these adjacent web-tensioning segments from the pilot control in the relevant web-tensioning segment. The cascading can be carried out with different factors, for example inversely, proportionally, on a shared basis, etc.

In a likewise advantageous fashion, the pilot control is also carried out taking into account the rotation speed change of the clamping point. Since the error to be expected is proportional to the rotation speed change occurring, i.e. positive or negative acceleration of the axle, this acceleration is advantageously also taken into account in the pilot control. The acceleration can, for example, be determined through derivation of certain sensor values, for example double derivation of the position sensor values or single derivation of the speed sensor values. For the position or speed measurement, it is possible, for example, to scan information printed onto the product web, e.g. marks, perforations, etc. It is likewise possible to carry out the determination by means of an acceleration sensor.

Another possibility is to transmit values for the regulation of the web tension or register from the machine control unit to the computing unit, e.g. by means of field bus communication; it is possible, for example, to transmit a set point position, set point speed, set point acceleration, set point lurch, actual position, actual speed, actual acceleration, or actual lurch of the machine control position. It is also possible to transmit binary signals that indicate a speed change from the machine control unit to the computing unit for the regulation of the web tension and register and it is possible to know fixed, preset lurches and acceleration values in the computing unit for the regulation of web tension and register. Finally, an estimation of the acceleration can be carried out based on other process values, such as the drive moments.

In an advantageous modification of the processing or printing machine according to the invention, the computing unit is equipped to carry out the steps described above.

In a processing machine according to the invention, the computing unit and the motion control of the driven axles and/or the machine process control are suitably integrated into a shared set of control hardware. Processing machines of this kind can be provided in a compact form and offer a simplified operation since they do not require combination with external components.

The invention also relates to a computer program equipped with programming code means for carrying out all of the steps of a method according to the invention when the computer program is run on a computer or a corresponding computing unit, particularly in a processing machine according to the invention.

The computer program product provided according to invention, which is equipped with programming code means that are stored on a computer-readable data storage medium, is embodied to carry out all of the steps of a method when the computer program is run on a computer or a corresponding computing unit, particularly in a processing machine. Suitable data storage devices include diskettes, hard disk drives, flash storage units, EEPROMs, CD-ROMs, DVDs, and the like. It is also possible for a program to be downloaded via computer networks (Internet, intranet, etc.).

Other advantages and embodiments of the invention ensue from the description and the accompanying drawings.

Naturally, the defining characteristics that are mentioned above and those explained in greater detail below can be used not only in the respective combination indicated, but also in other combinations or individually, without going beyond the scope of the present invention.

An exemplary embodiment of the invention is schematically depicted in the drawings and will be explained in extensive detail below in conjunction with the drawings.

BRIEF DESCRIPTION OF DRAWINGS

In FIG. 1, the curve of a web tension over time is plotted in a graph 10 depicting two web tension curves 13 and 14. In the graph 10, the web tension is plotted on a y axis 12 in relation to time t on an x axis 11. FIG. 1 shows the web tension curve in a dynamic case in which an acceleration of the involved rolls is taking place.

DETAILED DESCRIPTION OF THE PREFERRED EMBODIMENTS

Figure 3:
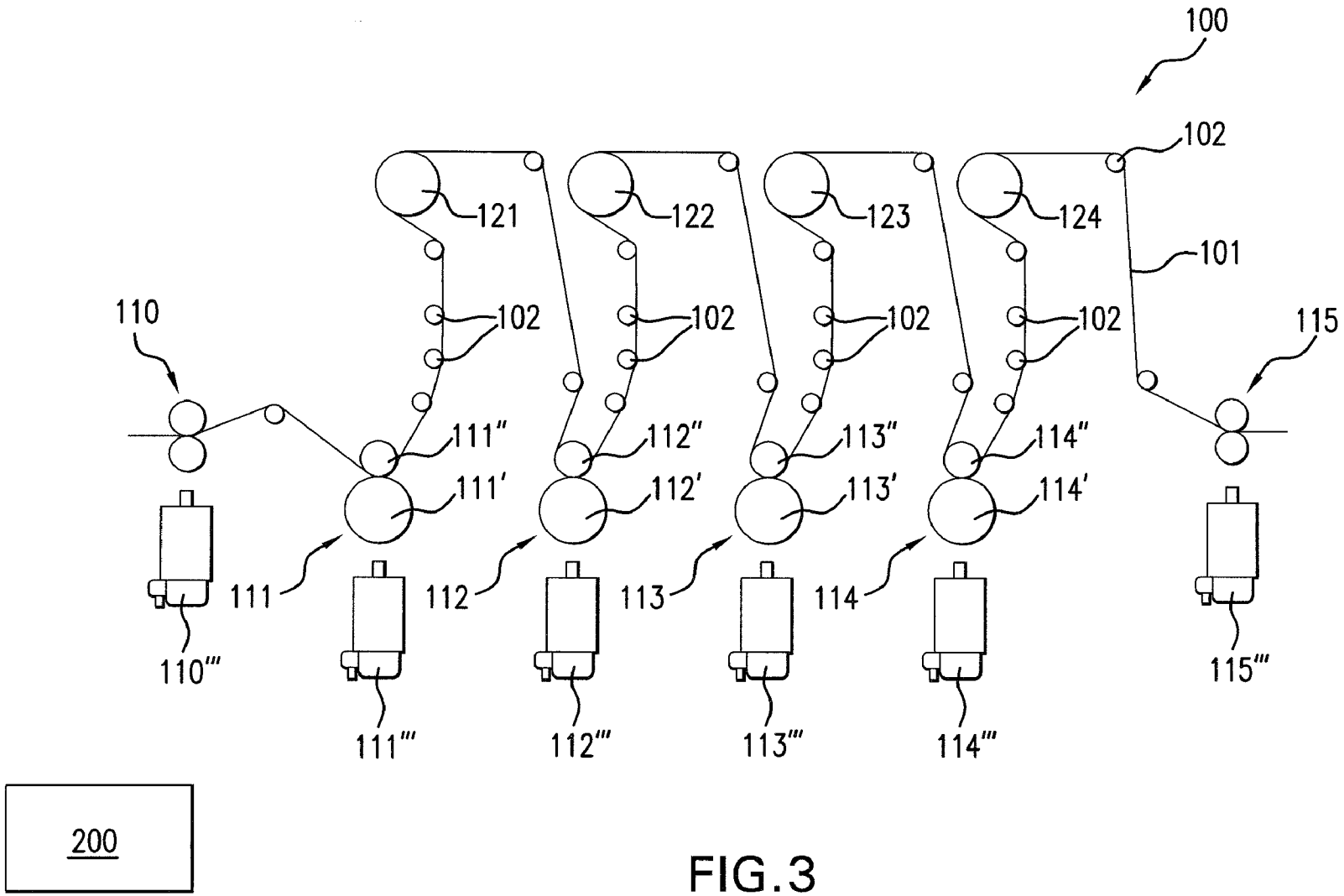
FIG. 3 schematically depicts a preferred embodiment of a processing machine according to the invention, embodied in the form of a printing machine.

The graph 10 shows two web tension curves 13 and 14, which are to be associated with different web-tensioning subsegments. The graph depicts a web-tensioning segment that is divided into two adjacent web-tensioning subsegments by a non-driven axle, a cooling roll in the example shown. A respective clamping point (driven axle), a driven printing roll in the example shown, is situated at each end of the web-tensioning segment. With reference to FIG. 3, such a web-tensioning segment can, for example, be identified between the printing unit 112 and the printing unit 113 and is divided into two web-tensioning subsegments by the cooling roll 122. It should be expressly noted at this point that the drawing in FIG. 3 shows a printing machine according to the invention in which the moment of inertia of the cooling roll 122 is taken into account for a pilot control, whereas FIG. 1 relates to a printing machine in which such a pilot control is not provided.

Following the course of the product web, the web-tensioning subsegment to be associated with the web tension curve 14 is situated between a clamping point and a non-driven axle, while the web-tensioning subsegment to be associated with the web tension curve 13 is situated directly after it in the course of the product web, between the above-mentioned non-driven axle and a subsequent clamping point.

As is clear from the graph 10, the web tension in the region between a clamping point and a subsequent non-driven axle regularly has a lower value than in the region between the above-mentioned non-driven axle and a subsequent clamping point.

Figure 1:
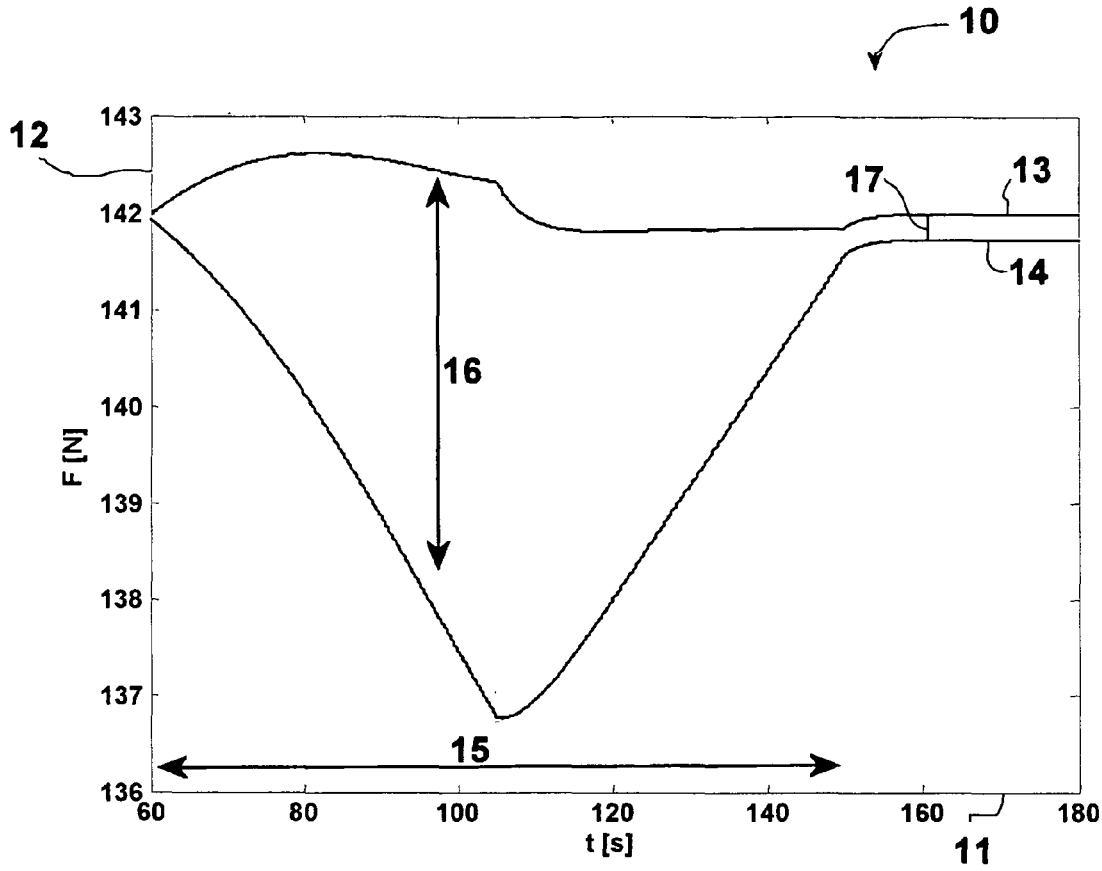
FIG. 1 schematically depicts a dependent relationship of a web tension to time in a dynamic case in the prior art.

In an acceleration phase 15 according to FIG. 1, a dynamic force 16, which corresponds to the difference between the web tension curves 13 and 14, is used to drive the non-driven roll. In example shown, the product web is accelerated from 30 m/min to 200 m/min within 90 s. This requires application of the moment of inertia and the friction, i.e. the effective moment of inertia, of the non-driven axle. During acceleration phase, the web tension decreases after a clamping point and increases before the subsequent clamping point since the non-driven roll is being accelerated.

After the acceleration, a steady state is reestablished in which customarily, the same web tension conditions prevail as before the acceleration. This state is depicted on the left side of the graph in FIG. 1, starting at approximately t=150 s. A moment of friction of the non-driven axle must be applied in the stationary state. This results in a higher web tension after a non-driven axle and the subsequent clamping point in the course of the product web since the clamping point must exert a force in order to drive the non-driven axle. This force corresponds to a difference 17 between the depicted web tensions 13 and 14.

Figure 2:
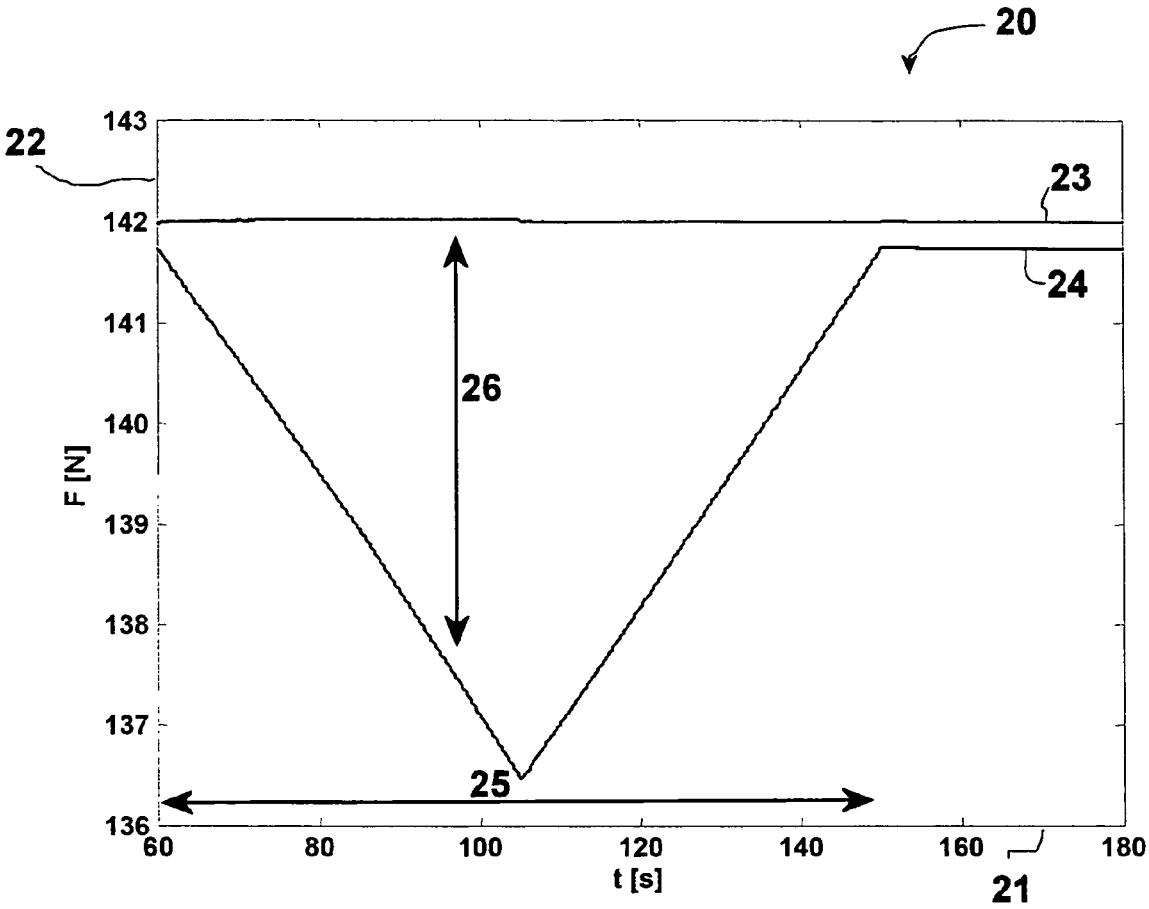
FIG. 2 schematically depicts a dependent relationship of a web tension to time with a preferred pilot control of a clamping point.

In FIG. 2, the curve of a web tension is plotted over time in a graph 20 depicting two web tension curves 23 and 24. This web tension curve according to FIG. 2 occurs when an embodiment of the method according to the invention is used. In the graph 20, the web tension is plotted on a y axis 22 in relation to time t on an x axis 21. FIG. 2 shows the web tension curve in a dynamic case in which an acceleration of the involved rolls is taking place.

In the graph 20, two web tension curves 23 and 24 are shown, which are to be associated with different web-tensioning subsegments in accordance with FIG. 1. With reference to FIG. 3, the web-tensioning subsegment to be associated with the web tension curve 24 is situated between a clamping point (e.g. a driven printing roll) and a non-driven axle (e.g. a cooling roll), while the web-tensioning subsegment to be associated with the web tension curve 23 is situated directly after it in the course of the product web, between the above-mentioned non-driven axle and a subsequent clamping point.

In an acceleration phase 25 according to FIG. 2, a dynamic force 26 which corresponds to the difference between the web tension curves 23 and 24, is used to drive the non-driven roll. In the example shown, the product web is once again accelerated from 30 m/min to 200 m/min within 90 s. To execute a pilot control, an additive angular value is given to the downstream roll in the course of the acceleration phase. This angular value is proportional to the speed change or acceleration and to the inertia of the non-driven rolls. It is clear that the web tension curve 23 with the pilot control that is used can be kept almost constant through the use of additive acceleration-dependent angular values. A processing error is advantageously reduced for all processing axles situated in this web-tensioning subsegment.

FIG. 3 shows a preferred embodiment of a processing machine or printing machine according to the invention, embodied in the form of printing machine that is labeled as a whole with the reference numeral 100. A printing stock, for example paper 101, is fed into the machine via an infeed unit 110. The paper 101 is conveyed through clamping points embodied in the form of printing units 111, 112, 113, 114 and then conveyed out again by means of an outfeed unit 115. The infeed unit, outfeed unit, and printing units 110 through 115 are situated in a positionable fashion, in particular so that they can be cylindrically and angularly corrected. The printing units 111 through 114 are situated in a web tension-regulated region between the infeed unit 110 and the outfeed unit 115.

The printing units 111 through 114 each have a printing cylinder 111' through 114' against which a pressure roll 111" through 114" is placed with a powerful pressure. The printing cylinders 111' through 114' are driven individually and independently. The associated drive units 111'" through 114'" are schematically depicted. The pressure rolls 111" through 114" are embodied as freely rotating. The infeed unit 110 and outfeed unit 115 each have two respective cylinders rotating in opposite directions, which guide the paper 101. In addition, the infeed unit 110 and outfeed unit 115 are each individually driven by a respective drive unit 110'" and 115'". The infeed unit 110 and outfeed unit 115 and the printing units 111 through 114, together with the paper 101 traveling through them, each constitute a respective frictionally connected unit. The infeed unit 110, the outfeed unit 115, and the printing units 111 through 114 each represent a respective clamping point.

In the web sections between the individual printing units 111 through 114, the paper 101 is guided via rolls that are labeled 102 and are not explained in greater detail. For the sake of clarity, not all of the rolls are provided with the reference numeral 102. In particular, these can be deflecting rolls, drying rolls, cutting devices, etc.

After a printing step in one of the printing units 111 through 114, the web 101 is conveyed around cooling rolls. For this purpose, a cooling roll 121 is situated in the web section between the first printing unit 111 and the second printing unit 112, a cooling roll 122 is situated in the section between the second printing unit 112 and the third printing unit 113, a cooling roll 123 is situated in the section between the third printing unit 113 and the fourth printing unit 114, and a fourth cooling roll 124 is situated in the section between the fourth printing unit 114 and the outfeed unit 115.

The cooling rolls 121 through 124 and the rolls 102 each have an effective moment of inertia that negatively influences an acceleration phase of the printing machine. In the preferred embodiment of a printing machine shown, all of the clamping points are pilot controlled during an acceleration phase, taking into account the effective moments of inertia of the cooling rolls 121 through 124 and of the rolls 102. The effective moments of inertia are determined ahead of time by means of a test run and a subsequent evaluation. During an acceleration phase, a pilot control is carried out, which takes into account these effective moments of inertia. The pilot control here can be carried out, for example, with the aid of a DT1 element (differentiating delay element), where T1 mis selected to be proportional to the web length/machine speed. The pilot control can include additive angular values. This yields a virtually constant web tension curve in a desired segment of the product web, as depicted in FIG. 2.

A description is given below of how the pilot control is incorporated into a regulation of the web tension and/or register in the preferred embodiment of the printing machine shown.

The web is preferably provided with a first sensor between the infeed unit 110 and the first printing unit 111 and is provided with a second sensor between the last printing unit 114 and the outfeed unit 115; these sensors are embodied in the form of web tension sensors. Web tension values detected by the sensors (not shown) are supplied to a device for web transport regulation (tension regulator). As a function of the web tension values, the tension regulator controls the drive units 110'" and 115'" of the infeed unit 110 and outfeed unit 115 and also advantageously controls the drive units 111'" through 114'" of the printing units 111 through 114. During an acceleration phase, i.e. with a speed decrease or increase, the tension regulator once again executes a pilot control of the infeed unit 110 and the outfeed unit 115 and also of the printing units 111 through 114, taking into account the effective moments of inertia of the non-driven axles 102 and 121 through 124.

Alternatively or in addition, sensors (not shown) are preferably situated in the individual web segments between the printing units 111 through 114; these sensors determine the register position of the product web 101 and to this end, are embodied in the form of mark readers, for example. As the product web 101, e.g. paper, passes through, a mark reader detects when a printing mark (not shown), which is preferably applied by the first printing unit 111, reaches the mark reader. The measurement value is supplied to a device for regulating the register (a register regulator). Then, the position of the corresponding printing cylinder 112' through 114' is determined and this measurement value is likewise supplied to the register regulator. A respective register deviation can be calculated based on it (web/cylinder correction).

The determined register deviations are used to position the printing units 111 through 113 and preferably also for the positioning of the infeed unit 110 and the outfeed unit 115. In an acceleration phase, i.e. with a speed decrease or increase, the register regulator once again carries out a pilot control of the printing units 111 through 113 and preferably also of the infeed unit 110 and outfeed unit 115, taking into account the effective moments of inertia of the non-driven axles 102 and 121 through 124.

Naturally, the tension regulator and register regulator mentioned up to this point can be incorporated into a shared computing unit 200, for example a computer.

It goes without saying that only one particularly preferred embodiment of the invention is shown in the figures provided here. It is conceivable to embody it in any other way without going beyond the scope of this invention.

REFERENCE NUMERAL LIST

10, 20 graph
11, 21 x axis
12, 22 y axis
13, 14, 23, 24 web tension curve
15, 25 acceleration phase
16, 17, 26 force
100 printing machine
101 paper
102 roll
110 infeed unit
110'" drive unit
111, 112, 113, 114 printing unit
111', 112', 113', 114' printing cylinder
111", 112", 113", 114" pressure roll
111'", 112'", 113'", 114'" drive unit
115 outfeed unit
115'" drive unit
121, 122, 123, 124 cooling roll

What is claimed is:

1. A method for axial correction in a processing machine (100), comprising the following steps:

providing the processing machine, wherein said processing machine has at least two driven transport axles (110, 115) for transporting and processing a product web (101), at least one non-driven or driven processing axle (111, 112, 113, 114), and at least one additional non-driven axle (102, 121, 122, 123, 124), wherein the product web (101) includes at least one web-tensioning segment;

delimiting the at least one web-tensioning segment by two clamping points (110-115), wherein said clamping points are embodied in the form of driven transport or processing axles; and performing a pilot control of one of the clamping points (110-115) that delimits the web-tensioning segment, performing a pilot control of a processing axle (111-114) situated in the at least one web-tensioning segment, or performing both a pilot control of the clamping point and said processing axle during a rotation speed change of one of said clamping points (110-115) that delimits the at least one web-tensioning segment; and taking into account a moment of inertia of a non-driven axle (102, 121-124) situated in the at least one web-tensioning section during said step of performing a pilot control.

2. The method as recited in claim 1, wherein the pilot control is carried out taking into account the respective moment of inertia of all of the non-driven axles (102, 121-124) situated in the at least one web tension segment.

3. The method as recited in claim 2, wherein the respective moments of inertia of all of the non-driven axles (102, 121-124) situated in the at least one web tension segment are concentrated into an overall moment of inertia to be taken into account for the at least one web-tensioning segment.

4. The method as recited in claim 1, further comprising the step of cascading pilot control values for the pilot control of the clamping point (110-115), of the processing axle (111-114), or of both the clamping point (110-115) and processing axle (111-114) in order to achieve a decoupling at the clamping point (110-115)), of the processing axle (111-114), or of both the clamping points (110-115), and processing axle (111-114) of adjacent web-tensioning segments.

5. The method as recited in claim 1, wherein the pilot control occurs taking into account the rotation speed change.

6. A processing machine (100), comprising:

at least two driven transport axles (110-115) configured for transporting and processing a product web (101);

at least one non-driven or driven processing axle (111-114);

at least one additional non-driven axle (102, 121-124), wherein the product web (101) includes at least one web-tensioning segment, wherein the at least one web-tensioning segment is delimited by two clamping points (110-115) embodied in the form of driven transport or processing axles; and a computing unit (200) configured to perform a pilot control of the clamping point (110-115) delimiting the web-tensioning segment, to perform a pilot control of a processing axle (111-114) situated in the at least one web-tensioning segment, or to perform both a pilot control of the clamping point and the processing axle by means of pilot control values during a rotation speed change of a clamping point (110-115) delimiting the at least one web-tensioning segment, taking into account a moment of inertia of a non-driven axle (102, 121-124) situated in the at least one web-tensioning section.

7. The processing machine (100) as recited in claim 6, wherein the computing unit (200) is configured to determine the pilot control values, taking into account the respective moment of inertia of all of the non-driven axles (102, 121-124) situated in the at least one web-tensioning segment and to concentrate the respective moments of inertia of all of the non-driven axles (102, 121-124) situated in the at least one web tension segment into an overall moment of inertia to be taken into account for the at least one web-tensioning segment.

8. The processing machine (100) as recited in claim 6, wherein the computing unit (200) is configured to determine the pilot control values, taking into account the rotation speed change.

9. The processing machine (100) as recited in claim 6, wherein the computing unit (200) and the motion control of the driven axles (110-115), the machine process control or both the motion control and the machine process control are integrated into a shared set of control hardware.

* * * * *